US007730824B1

(12) United States Patent
Black

(10) Patent No.: US 7,730,824 B1
(45) Date of Patent: Jun. 8, 2010

(54) PRECISION TACTICAL MOUNT

(76) Inventor: Robert O. Black, 537 Easy St., Garland, TX (US) 75042

( * ) Notice: Subject to any disclaimer, the term of this patent is extended or adjusted under 35 U.S.C. 154(b) by 485 days.

(21) Appl. No.: 11/888,410

(22) Filed: Jul. 31, 2007

(51) Int. Cl.
*F41A 23/00* (2006.01)

(52) U.S. Cl. ..... 89/37.03; 89/37.04; 89/37.01; 89/37.09; 89/37.13; 89/40.01; 89/40.06; 42/94

(58) Field of Classification Search ..... 89/37.01–37.04, 89/37.09, 37.13, 40.01, 40.06; 42/94
See application file for complete search history.

(56) References Cited

U.S. PATENT DOCUMENTS

| | | | | | |
|---|---|---|---|---|---|
| 499,315 | A * | 6/1893 | Borchardt | 89/132 |
| 3,115,062 | A * | 12/1963 | Tassie et al. | 89/37.01 |
| 3,225,656 | A * | 12/1965 | Flaherty et al. | 89/37.04 |
| 3,358,504 | A * | 12/1967 | Freebairn | 73/167 |
| 4,721,026 | A * | 1/1988 | Arana Ibarra | 89/37.05 |
| 4,967,497 | A * | 11/1990 | Yakscoe | 42/94 |
| 4,972,619 | A * | 11/1990 | Eckert | 42/94 |
| 5,067,268 | A * | 11/1991 | Ransom | 42/94 |
| 5,081,783 | A * | 1/1992 | Jarvis | 42/94 |
| 5,697,181 | A * | 12/1997 | Savant | 42/94 |
| 5,913,668 | A * | 6/1999 | Messer | 42/94 |
| 6,305,117 | B1 * | 10/2001 | Hales, Sr. | 42/94 |
| 6,338,218 | B1 * | 1/2002 | Hegler | 42/94 |
| 6,439,515 | B1 * | 8/2002 | Powers | 248/129 |
| 6,526,687 | B1 * | 3/2003 | Looney | 42/94 |
| D506,521 | S * | 6/2005 | Strahan | D22/108 |
| D519,183 | S * | 4/2006 | Minneman | D22/108 |
| 7,047,863 | B2 * | 5/2006 | Hawkes et al. | 89/37.04 |
| 7,086,192 | B2 * | 8/2006 | Deros | 42/94 |
| 7,415,790 | B1 * | 8/2008 | Ruhland et al. | 42/94 |
| 7,584,690 | B2 * | 9/2009 | Cauley | 89/37.04 |
| 2004/0134113 | A1 * | 7/2004 | Deros et al. | 42/94 |
| 2007/0266609 | A1 * | 11/2007 | Wuertz | 42/94 |
| 2008/0209790 | A1 * | 9/2008 | Bartle | 42/94 |
| 2009/0113779 | A1 * | 5/2009 | Shipman et al. | 42/94 |

* cited by examiner

*Primary Examiner*—Bret Hayes
*Assistant Examiner*—Michael D David
(74) *Attorney, Agent, or Firm*—Mark W Handley

(57) ABSTRACT

A precision tactical mount (12) includes a horizontal controller (30) and a vertical controller (34) for determining azimuth angles and elevation angles for a sight line of the precision tactical mount (12). The horizontal controller (30) and the vertical controller (34) have friction blocks (102, 114, 196) which engage mating friction surfaces with selectable forces for providing specific resistance against azimuth and elevation angular movement, without requiring separate mechanisms for locking the tactical mount (12) in selected positions. The friction blocks (102, 114 and 196) are preferably formed of softer materials than the mating friction surfaces to conform to the shape of the mating friction surfaces with increased normal forces, providing varying surface areas. The vertical controller (34) includes a course threaded screw member (142) mounted at an angle to a centerline (6) of the precision tactical mount (12) to provide fine control adjustment for elevation.

20 Claims, 5 Drawing Sheets

PRECISION TACTICAL MOUNT

TECHNICAL FIELD OF THE INVENTION

The present invention relates in general to tactical mounts, and in particular, to a tactical mount for selectively aiming an object at a target.

BACKGROUND OF THE INVENTION

Prior art tactical mounts have been provided for aiming various objects at targets. Objects being aimed have included firearms, such as hunting rifles and tactical weapons, cameras, and the like. Prior art tactical mounts for controlling the aim of an object at targets have included fine and course threaded adjustments for aiming the objects relative to two different axes, such for determining an azimuth angle and elevation for a sight line of the object. Some prior art tactical mounts have included two sets of fine and course threaded adjustment mechanisms, each set corresponding to different perpendicular axes for azimuth and elevation. Typically, fine adjustment mechanisms are provided by micro-screw threaded assemblies having very fine screw threads. Course adjustment mechanisms have been provided by threaded assemblies having course screw threads. A target is acquired such that the object is aimed at a target by selectively manipulating the fine and course adjustment mechanisms for each axis about which the object is rotated. Release and then securing of coarse adjustment mechanisms typically results in a bumping movement, in which the direction in which the object is aimed jumps to a direction which is not directly pointing toward the target, requiring re-acquisition of the target after course adjustments are made. Following a moving target is often difficult due to the constant need to switch between fine and gross adjustment mechanisms, and thread run-out may be encountered which limit the range of motion for which a tactical mount may be moved without requiring return of threaded mechanisms to a mid-range position. If adjustment is required in for both azimuth and elevation to follow a moving target, this often requires that a user not continuously focus his line of sight on a target, but instead must periodically view the adjustment mechanisms to assure that the adjustment mechanisms are being correctly operated.

SUMMARY OF THE INVENTION

A novel precision tactical mount is disclosed having a vertical controller for determining elevation direction and a horizontal controller for determining azimuth direction. The vertical controller and the horizontal controller have friction means for selectively determining specific resistance to angular movement of a rigid support member about respective axes. The horizontal controller provides adjustment of specific resistance to moving about a vertical axis for aiming the tactical mount in selected horizontal directions. A vertical controller provides adjustments for both specific resistance to moving about a horizontal axis and a threaded fine control adjustment mechanism for determining the elevation at which the object is aimed. The specific resistance adjustments for both the horizontal controller and the vertical controllers allow users to continuously track a moving target with a smooth and continuous motion, at the same time as fine tuning adjustments may be made to specifically determine actual resistance against angular movement of the precision tactical mount without interfering with smooth angular motion of the tactical mount and without requiring a user to remove his line of sight from an acquired target. The specific resistance adjustments include friction blocks having arcuately shaped surfaces which conform to the shapes of mating friction surfaces, and which are preferably formed a softer materials than that of which mating friction surfaces are formed such that the arcuately shaped surfaces will engage the mating friction surfaces with varying surface areas as adjustments are made to the pressures at which the surfaces engage. The roughness of the arcuately shaped surfaces and mating friction surfaces are preferably very smooth, and formed of dissimilar materials. The threaded fine control adjustment mechanism is selectively accessible and operable by a user without the user removing his focus from a line of sight with the target. Preferably, the threaded fine control adjustment mechanism is provided by use of a course threaded screw assembly mounted at an angle to the plane in which the elevation of a target line toward the target is defined. A user may continuously maintain a line of sight on both stationary and moving targets, while tracking the target to various positions.

DESCRIPTION OF THE DRAWINGS

For a more complete understanding of the present invention and the advantages thereof, reference is now made to the following description taken in conjunction with the accompanying Drawings in which

FIG. 1 is a perspective view of the precision tactic mount;

FIG. 2 is a side elevation view of the precision tactical mount;

FIG. 3 is an exploded view of a vertical controller;

FIG. 4 is a cross sectional view of the vertical controller;

FIG. 5 is perspective view of an outer friction block for the vertical controller;

FIG. 6 is partial section view of the friction slide for the vertical controller taken along section line 6-6 of FIG. 4;

FIG. 7 is an exploded, perspective view of a horizontal controller; and

FIG. 8 is partial section view taken along section line 8-8 of FIG. 2.

DETAILED DESCRIPTION OF THE INVENTION

Figure 1:
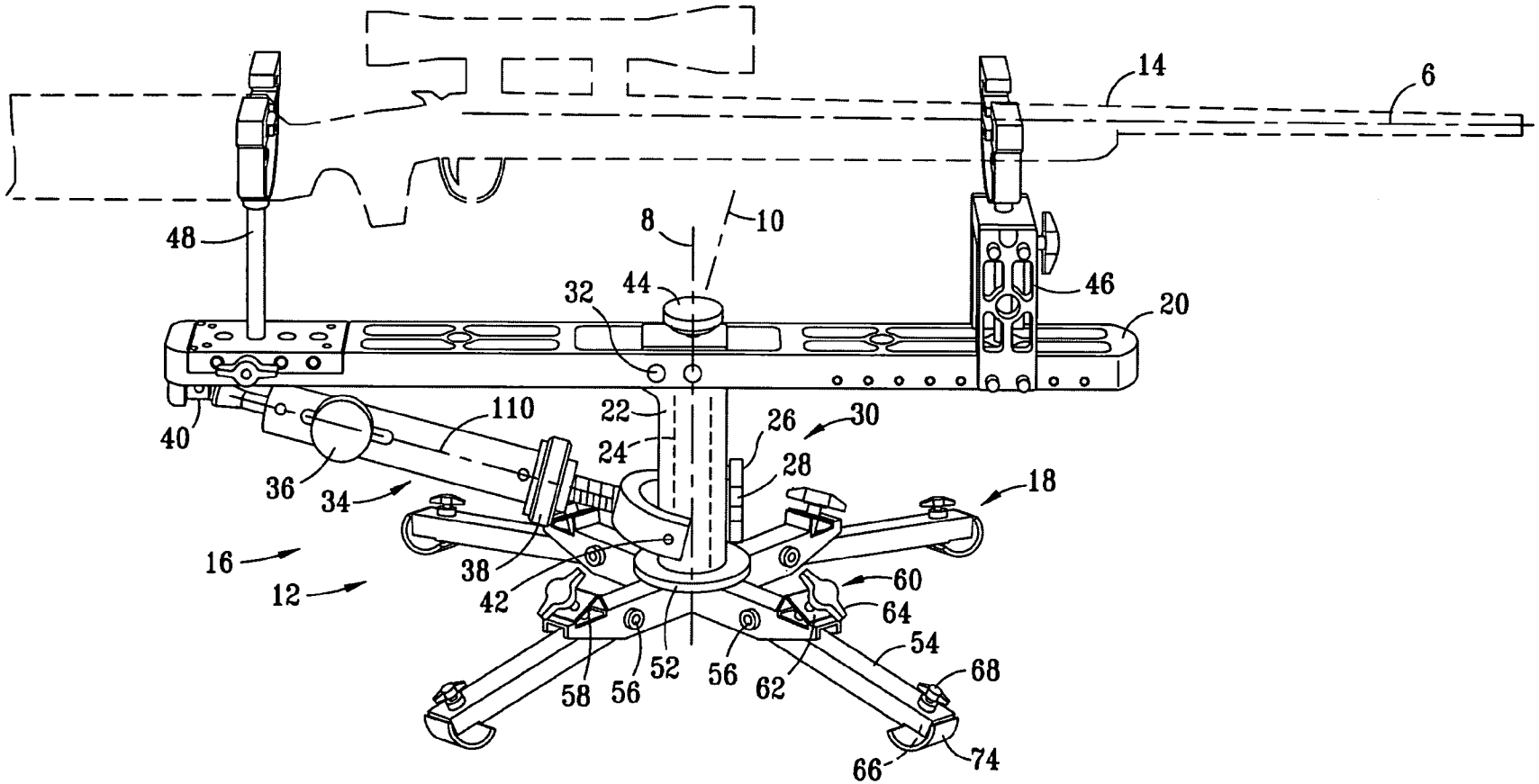
FIGS. 1 through 8 show various aspects for a precision tactical mount made according to the present invention, as set forth below.
Figure 2:
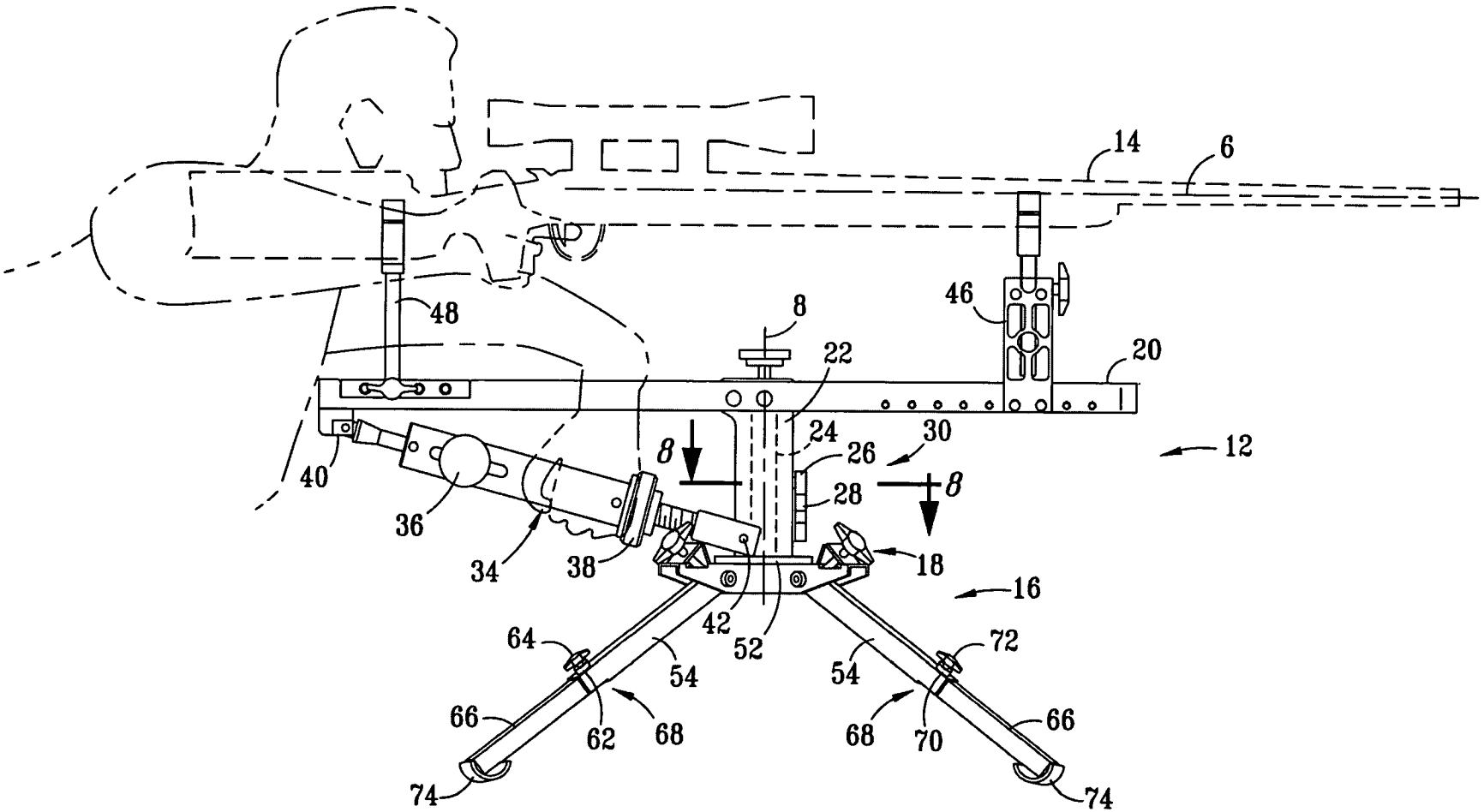

FIG. 1 is a perspective view and FIG. 2 is a side elevation view of a precision tactical mount 12 for mounting a firearm 14 and selectively moving a centerline 6 of a barrel for the firearm 14 around an axis 8 for an azimuth angle and an axis 10 for an elevation angle in aiming the firearm 14 at a target. The precision tactical mount 12 includes a mounting assembly 16 and a mounting base 18. The mounting assembly 16 includes a rigid mounting member 20 which is pivotally mounted to the mounting base 18 by support member 22. The support member 22 is rotatably secured to a spindle 24. The spindle 24 is preferably welded to a mounting plate 52 which is secured to the mounting base 18.

The mounting assembly 16 includes a selectively adjustable friction lock 26 which provides a rotary lock 28 and a horizontal controller 30 for determining an angular direction in which the mounting member 20 extends. The selectively adjustable friction lock, or rotary lock, 26 provides a specifically adjustable friction for determining the torque required or force required to rotate the support member 22 about the spindle 24 for determining an azimuth angle. A pivot pin 32 pivotally secures the rigid mounting member 20 to the upper end of the support member 22 and allows the rigid mounting member 20 to pivot in a single vertical plane relative to the support member 22 for determining an angular elevation of the mounting member 20.

The mounting assembly 16 further includes a vertical controller 34 for controlling the elevation of one end of the rigid mounting member 20 relative to the opposite end. The vertical controller 34 has a longitudinal axis 110 about which it extends which is preferably disposed at a ten degree angle to the centerline 6. The vertical controller 34 includes a selectively adjustable friction lock 36, which provides a linearly extending lock having a specifically adjustable resistance. The vertical controller 34 also includes a micro elevation adjustment 38. The micro elevation adjustment 38 is provided by a screw adjustment which extends at an angle to the centerline 6 of the rigid mounting member 20, preferably at the ten degree angle along the longitudinal axis 110. A ten degree angle allows a course, 16 pitch thread to be used for a threaded rod 142 (shown in FIG. 3) to provide micro adjustment of 0.10 inches with one rotation, which is an adjustment equivalent to a fine, 94 pitch thread disposed perpendicular to the centerline 6. The vertical controller 34 is pivotally mounted to the rearward end of the support member 22 by a pivot pin 40, which defines a second pivot axis. The forward end of the vertical controller 34 is pivotally mounted to the support member 22 by a pivot pin 42, which defines a first pivot axis. A front mount 46 and a rear mount 48 are provided on the forward and rearward ends, respectively, of the rigid mounting member 20 for securing the firearm 14 with respect to the rigid mounting member 20. Preferably, the front mount 46 and the rear mount 48 are drop in type mounts, such that the firearm 14 can be dropped through the open upward ends of the mounts 46 and 48, without being rigidly constrained to the rigid mounting member 20 without a degree of freedom for movement in response to being fired. The support member 22 is preferably secured to the spindle 24 by a lock knob 44, which secures to a threaded end 50 of the spindle 24.

The mounting base 18 includes a base plate 52 and support legs 54. The support legs 54 are pivotally mounted to the base plate 52 by pivot pins 56. An angled portion 58 of the base plate 52 is provided within which the support legs 54 are secured by the pivot pins 56. Locks 60 are provided by inserted rods 62 and handles 64 for determining the angle at which the support legs 54 extend relative to the base plate 52. Leg extensions 66 are slidably extendable from within the support legs 54. Extension locks 68 are provided for securing the leg extensions 66 in fixed relative positions relative to the support legs 54. The extension locks 68 are provided by threaded rods 70 and handles 72. Feet 74 are provided at the outward ends of the leg extensions 66.

Figure 3:
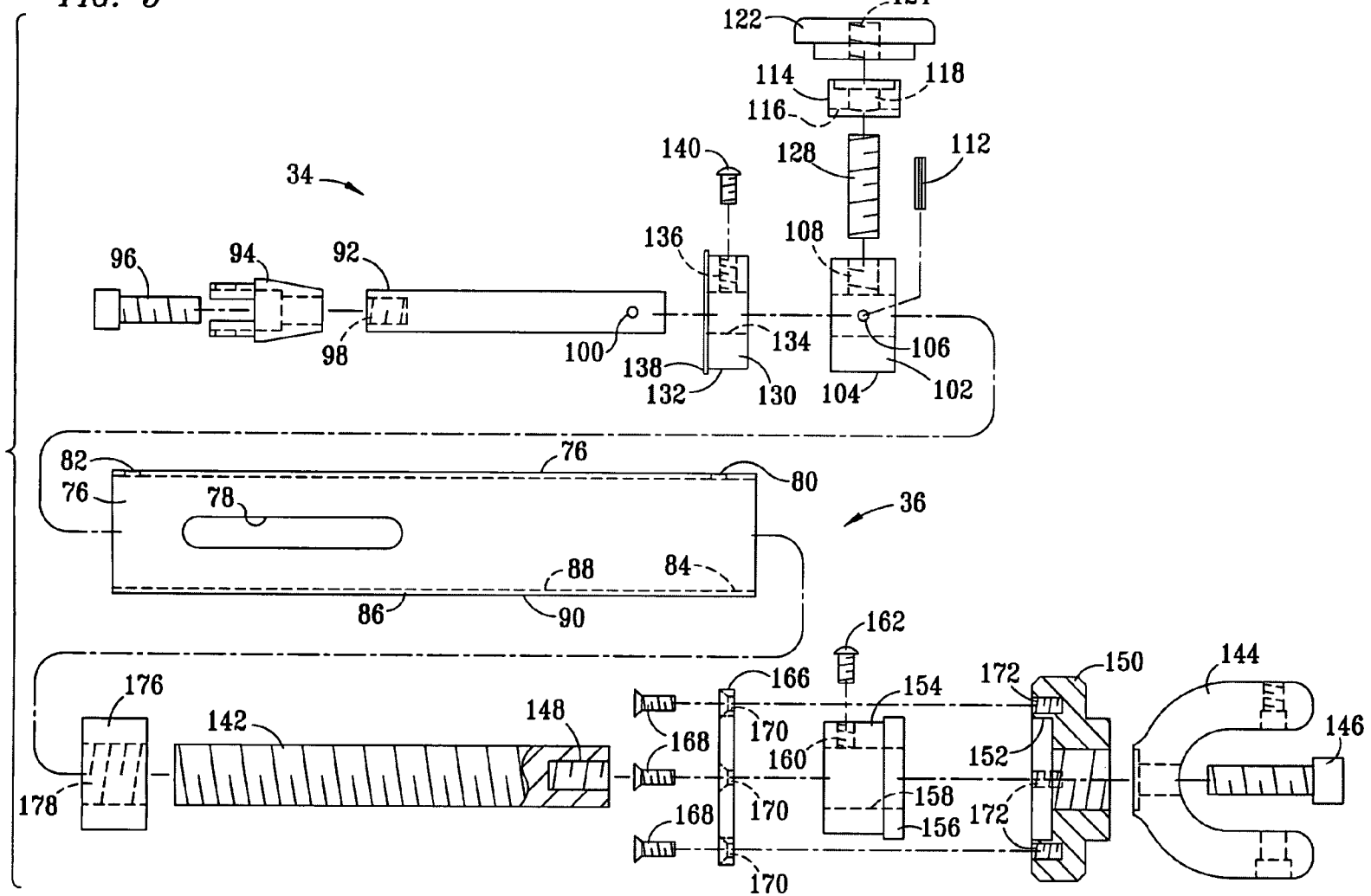
Figure 4:
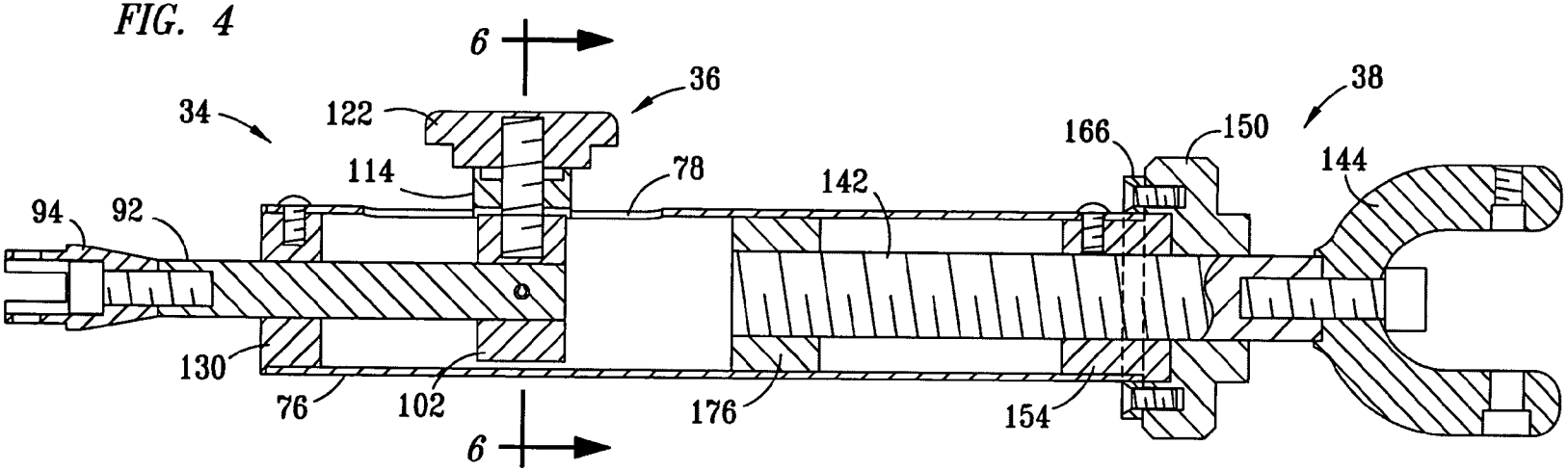

FIG. 3 is an exploded view and FIG. 4 is a cross sectional view of the vertical elevation controller 34. Vertical elevation controller 34 includes a sleeve 76 having a longitudinally extending slot 78 on one end portion. Mounting holes 80 and 82 are disposed on opposite longitudinal ends of the sleeve 76. The sleeve 76 has a longitudinally extending bore 84 defining a wall 86 having an interior surface 88 and an exterior surface 90. The selectively adjustable linear friction lock 36 includes a rod 92 which is secured on one end with a yoke 94 by a fastener 96 which fits into the threaded end 98 of the rod 92. A mounting hole 100 is provided on the opposite end of the rod 92 for securing an inner friction block 102 to the inward end of the rod 92. The inner friction block 102 has an annular shaped outer surface 104 which engages and fits substantially flush against the inner surface 88 of the sleeve 76. The inner friction block 102 also includes a mounting hole 106 and a threaded hole 108 which extend into the surface 104. A fastening pin 112 is provided for extending through the mounting hole 106 and into the mounting hole 100 in the rod 92 to secure the inner friction block 102 in fixed relation to the rod 92. An outer friction block 114 is secured by a threaded fastener pin 128 to the sleeve 76 and the inner friction block 114. The outer friction block 114 has a concave, arcuately shaped, inwardly facing surface 116 for engaging and fitting substantially flush against the outer surface 90 of the sleeve 76. A second through hole 118 extends through the friction block 118. A friction adjustment handle 122 has a threaded hole 124. A threaded fastener pin 128 is threadingly secured within the threaded hole 124, extends through the through hole 118 in the outer friction block 114 and is threadingly secured within the threaded hole 108 in the inner friction block 102. The friction adjustment handle 122 may be used to adjust the pressure at which the wall 86 of the sleeve 76 is squeezed between the arcuate surface 116 of the outer friction block 114 and the annular shaped surface 104 of the inner friction block 102, to provide a specific resistance which must be overcome to move the rod 92 relative to the sleeved 76. Preferably, the outer friction block 122 and the inner friction block 102 are of a softer material than the sleeve 76, such that they will deform about the circumferentially extending surfaces of the sleeve 76 as the friction adjustment handle 122 is tightened to adjust the surface area with which the arcuately shaped friction surface 116 and the annular shaped friction surface 104 engage the sleeve 76, changing the sizes of the surface areas to provide a specifically adjustable friction. An end cap 130 has an annular shaped surface 132 for fitting flush with the inner surface 88 in an end of the sleeve 76, and a flange 138 which engages an end of the sleeve 76. A bore 134 is provided for passing the rod 92. A mounting hole 136 extends radially into the end cap 130. A threaded fastener 140 extends through the mounting hole 136 and into the mounting hole 100 in the inward end of the threaded rod 92.

The micro elevation adjustment 38 includes a threaded rod 142 having a first end to which a yoke 144 is attached by a fastener 146 which extends into a threaded end 148 of the threaded rod 142. The yoke 144 secures the threaded rod 142 to the support member 22 by means of the pivot pin 42 (shown in FIGS. 1 and 2). A collar 150 has a recess 152 within which a flange 156 of a stator 154 is received. The stator 154 preferably has a through hole 158 which provides clearance for passing the threaded rod 142 such that the threaded rod 142 does not touch nor engage the stator 152. The mounting hole 160 is provided in the stator 154 for receiving a mounting fastener 162 that passes through the mounting hole 80 in the sleeve 76 to rigidly secure the stator 154 in fixed relation to one end of the sleeve 76. The flange 156 is received within the recess 152 of the collar 150. An end plate 166 is secured by threaded fasteners 168 to the collar 150 to entrap the flange 156 of the stator 154 within the collar 150 such that the flange 156 rotates freely within the recess 152. Threaded fasteners 168 extend through holes 170 in the end plate 166 and into threaded holes 172 in the collar 150. The stator 154 is freely moveable between the end plate 166 and the collar 150. A spacer 176 is annular shaped and has a threaded hole 178 for threadingly securing to the end of the rod 142 to assure the end of the rod is centered within the sleeve 76.

Figure 5:
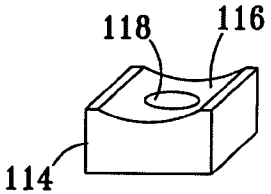

FIG. 5 is a perspective view of the outer friction block 114, showing the arcuate surface 116 and the through hole 118.

Figure 6:
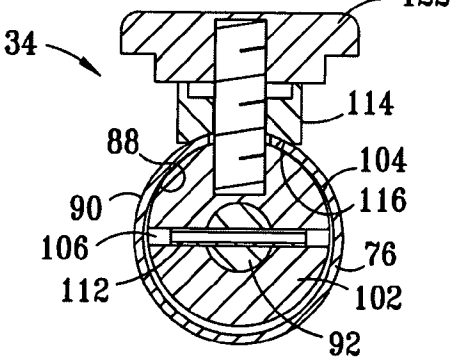

FIG. 6 is a partial section view of the vertical controller 34 taken along section line 6-6 of FIG. 4. The outer friction block 114 has an arcuately shaped, concave surface 116 for engaging against an outer surface 90 of the sleeve 76. The inner friction block 102 is shown mounted to the rod 92, and having an outward annular shaped surface 104 for engaging the inner wall 88 of the sleeve 76. The concave surface 116 and the annular shaped surface 104 are pressed against opposite sides 90 and 88 of the sleeve 76 to increase the force required to overcome the selected specific friction for moving the sleeve 76 relative to the rod 92, the inner friction block 102 and the outer friction block 114. Increasing the pressure at which the inner friction block 102 and the outer friction block 114 press against opposite sides 90 and 88 of the sleeve 76 causes the shapes of the surfaces 104 and 116 to deform and have greater surface area contact with the surfaces 88 and 90 of the sleeve 76, increasing the size of the friction force for moving the sleeve relative to the rod 92. Loosening the pressure applied by the inner friction block 102 and the outer friction block 114 to the sleeve 76 lowers the force required to overcome friction and move the sleeve relative to the rod 92.

Figure 7:
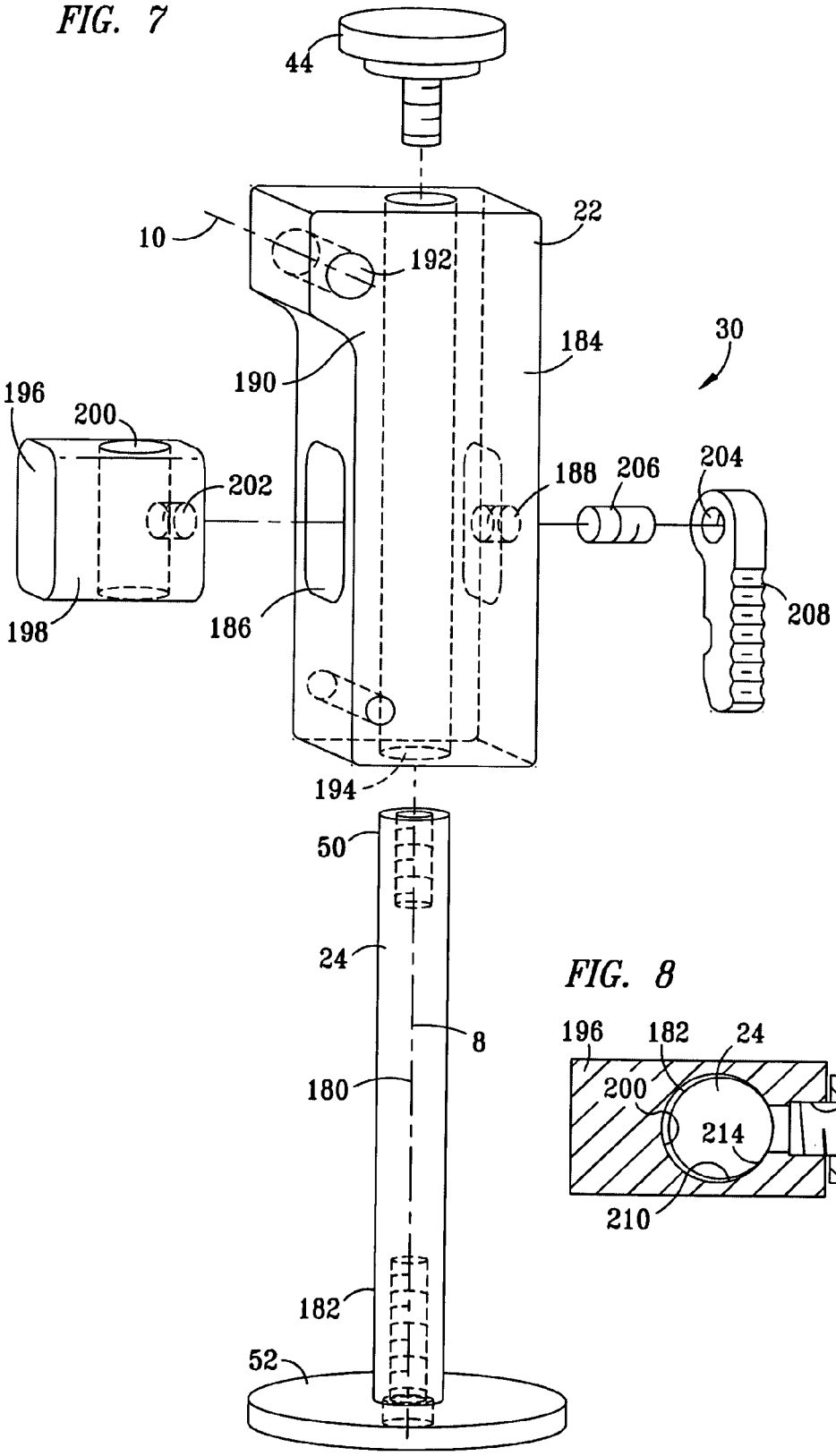

FIG. 7 is an exploded, perspective view of the horizontal controller 30 having the support member 22 and the spindle 24. The spindle 24 has circular surface 182 which extends circumferentially about the vertical axis 8, defining a spindle axis 180 which is coaxial with the axis 8 about which azimuth is determined. The support member 22 includes a block member 184 having a polished bore 194 for rotatably receiving the spindle 24, a blind hole 186, which defines a first aperture, and a through hole 188, which defines a third aperture. The through hole 188 defines an aperture which extends from the bottom of the blind hole 186 through a side of the block member 184. An upper pivot portion 190 of the block member 184 includes a pivot hole 192, which extends through the upper pivot portion 190 and defines a horizontal axis 10 about which elevation is determined. A grip block 196 has an arcuately shaped exterior periphery 198 which fits substantially flush with an arcuately shaped surface of the blind hole 186. The grip block 196 has a through hole 200 which defines a grip aperture for rotatably receiving the spindle 24. The grip block 196 also has a threaded hole 202 formed therein. A threaded rod 206 is provided for threadingly securing opposite ends into the threaded hole 202 in the grip block 196 and in a threaded hole 204 in the end of a grip handle 208. The threaded rod 206 and the grip handle 208 together provide a selective friction actuator.

Figure 8:
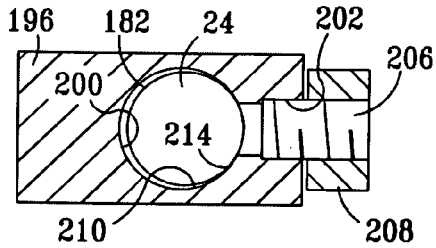

FIG. 8 is a partial section view of the horizontal controller, taken along section line 8-8 of FIG. 2. The through hole 200 of the grip block 196 is shown extending circumferentially around the spindle 24. The spindle 24 has a surface 182 which engages a portion of the through hole 200 along a friction engagement region 214. The threaded pin 206 extends into the grip block 196 and threadingly engages within a threaded hole 202 in the side of the grip block 196.

The precision tactical mount is preferably made of varying materials such that mating parts which frictionally engage for formed of dissimilar materials, to prevent sticking and bumping in movement. Preferably, the spindle 24 is formed of steel, and the support member 22 and the grip block 196 are formed of aluminum. Similarly, the sleeve 76 is formed of aluminum, and the inner friction block 102, the outer friction block 114 and the guide block 176 are formed of plastic, such as Teflon™. The rod 92 and the threaded rod 142 are formed of steel.

The precision tactical mount of the present invention which may be smoothly moved by a person in both horizontal and vertical angular directions, while simultaneously maintaining a line of sight toward a target and making adjustments to specific resistance for both horizontal and vertical controllers to determine specific resistance at which movement in either of the horizontal and vertical angular directions is opposed. A person may use his shoulder to move against the specific resistance for changing both azimuth and elevation angles, and the specific resistance will maintain the position into which the sight line of precision the tactical mount is moved. A threaded fine control adjustment mechanism also provides adjustment in the vertical angular direction, for determining elevation of the object being aimed at the target. Preferably, a course threaded screw assembly is mounted at an angle to the plane in which the elevation of a target line toward the target is defined to provide a low cost threaded fine control adjustment mechanism. Both fine and gross adjustments in the horizontal angular direction and the vertical angular direction in which the object is aimed may be determined by a user pushing against an end of the tactical mount of the present invention without requiring a separate lock mechanism to prevent further movement of the tactical mount, since a specific resistance may be selected to maintain the angular position of the tactical mount after being moved to a desired position by a user. The threaded find control adjustment may then be used for desired fine adjustments for elevation.

Although the preferred embodiment has been described in detail, it should be understood that various changes, substitutions and alterations can be made therein without departing from the spirit and scope of the invention as defined by the appended claims.

What is claimed is:

1. A precision tactical mount comprising:

a spindle secured to a mounting plate, said spindle having a spindle surface which circumferentially extends to define a spindle axis;

a support member having a central bore for receiving said spindle, with said central bore disposed for rotating about said spindle axis, and said support member having a first aperture which extends transverse to said central bore;

a grip block having a grip block surface and an exterior periphery, wherein said exterior periphery is slidably received within said first aperture in said support member for moving relative to said spindle and pressing said grip block surface against said spindle to define an engagement region between said grip block and said spindle;

a selective friction actuator mounted to said support member and engaging between said support member and said grip block for selectively engaging said grip block with said spindle in said engagement region with a selectable friction force for determining a level of a first force required for rotating said support member about said spindle;

a rigid mounting member pivotally secured to said support member for rotating about a second axis which extends transverse to said first axis, wherein said rigid mounting member defines a sight line for said precision tactical mount;

a slide mechanism extending between said rigid mounting member and said support member for selectively determining an angle at which said rigid mounting member is disposed relative to said support member, said slide mechanism having a first slide member pivotally connected to said support member at first pivot axis which is distally disposed from said second axis, a second slide member pivotally connected to said rigid mounting member at a second pivot axis which is distally disposed from said first pivot axis, and a third slide member which slidably connects between said first slide member and said second slide member;

a screw adjustment extending between said third slide member and a first one of said first slide member and said second slide member for selectively determining extension there-between;

a friction lock extending between said third slide member and a second one of said first slide member and said second slide member for selectively adjusting to determine a friction force there-between, which determines a level of a second force required to pivot said rigid mounting member relative to said support member about said second axis independent of said screw adjustment; and wherein azimuth and elevation for said sight line are selectively determined by moving said rigid mounting member relative to said spindle and said support member by selective application of said first force and said second force, and by operation of said screw adjustment.

2. The precision tactical mount according to claim 1, wherein a thread axis of said screw adjustment is disposed at an acute angle to said sight line defined by said rigid mounting member for obtaining a fine thread control adjustment with course screw threads.

3. The precision tactical mount according to claim 2, wherein said angle between said thread axis of said screw adjustment and said sight line is approximately ten degrees.

4. The precision tactical mount according to claim 1, further comprising said grip block having a second aperture for receiving said spindle, wherein said second aperture defines said grip block surface for pressing against said spindle surface, and said selective friction actuator moves said grip block within said first aperture formed into said support member in a transverse direction to said first axis defined by said spindle.

5. The precision tactical mount according to claim 4, wherein said selective friction actuator comprises a threaded pin and a grip handle mounted to a first end of said threaded pin, said grip block has a threaded hole for threadingly securing to a second end of said threaded pin, and a first through hole extends from an exterior of said support member into said first aperture for passing said second end of said threaded pin for securing within said threaded hole of said grip block and lineally moving said grip block with respect to said spindle.

6. The precision tactical mount according to claim 1, wherein said slide mechanism further comprises:

said first slide member including a threaded rod having one end pivotally secured to said support member and an other end extending to said third slide member; and said screw adjustment comprises a threaded collar which is pivotally mounted to said third slide member for threadingly receiving said threaded rod and rotating to determine lineal extension of said threaded rod relative to said third slide member.

7. The precision tactical mount according to claim 1, wherein said a friction lock of said slide mechanism further comprises a friction block moveably secured to said second one of said first and second slide members, for selectively moving to press against said third slide member with different levels of force.

8. The precision tactical mount according to claim 1, wherein said third slide member comprises a sleeve having a having a longitudinally extending bore and a longitudinally extending slot, and said friction lock comprises:

an inner friction block secured to a first end of said second slide member, said inner friction block having an annular-shaped surface for slidably moving within said longitudinally extending bore of said sleeve, and a lateral hole disposed to extend from one aide of said annular-shaped surface;

an outer friction block having an inwardly facing surface for slidably engaging said sleeve, and a second through hole extending transverse to said inwardly facing surface;

a friction adjustment handle having a fastener pin hole; and a fastener pin extending from said lateral hole in said inner friction block, through said longitudinally extending slot in said sleeve, through said second through hole in said outer friction block and into said fastener pin hole in said friction adjustment handle, wherein one of said fastener pin hole and said lateral hole is threaded for engaging a threaded end of said fastener pin to press said outer friction block and said inner friction block together with said sleeve disposed there-between to selectively determine said level of said second force required to pivot said rigid mounting member relative to said support member about said second axis independent of said screw adjustment.

9. The precision tactical mount according to claim 8, wherein said slide mechanism further comprises:

said first slide member including a threaded rod having one end pivotally secured to said support member and an other end extending to said third slide member; and said screw adjustment comprises a threaded collar which is pivotally mounted to said third slide member for threadingly receiving said threaded rod and rotating to determine lineal extension of said threaded rod relative to said third slide member.

10. The precision tactical mount according to claim 9, further comprising said grip block having a second aperture for receiving said spindle, wherein said second aperture is polished to define said grip block surface for pressing against said spindle surface, and said selective friction actuator moves said grip block within said first aperture formed into said support member in a transverse direction to said first axis defined by said spindle.

11. The precision tactical mount according to claim 10, wherein said selective friction actuator comprises a threaded pin and a grip handle mounted to a first end of said threaded pin, said grip block has a threaded hole for threadingly securing to a second end of said threaded pin, and a first through hole extends from an exterior of said support member into said first aperture for passing said second end of said threaded pin for securing within said threaded hole of said grip block and lineally moving said grip block with respect to said spindle.

12. The precision tactical mount according to claim 11, wherein a thread axis of said screw adjustment is disposed at an acute angle to said sight line defined by said rigid mounting member for obtaining a fine thread control adjustment with course screw threads.

13. A precision tactical mount comprising:

a spindle secured to a mounting plate, said spindle having a spindle surface which circumferentially extends to define a spindle axis;

a support member having a central bore for receiving said spindle, with said central bore disposed for rotating about said spindle axis, and said support member having a first aperture which extends transverse to said central bore;

a grip block having a second aperture for rotatably receiving said spindle, said second aperture defining a grip block surface for pressing against said spindle surface, and said grip block having an exterior periphery which is slidably received within said first aperture in said support member for moving relative to said spindle and pressing said grip block surface against said spindle to define an engagement region between said grip block and said spindle;

a selective friction actuator mounted to said support member and engaging between said support member and said grip block for selectively moving said grip block within said first aperture formed into said support member in a transverse direction to said first axis defined by said spindle to press said grip block surface into said spindle and providing a selected friction force for determining a level of first force required for rotating said support member about said spindle;

a rigid mounting member pivotally secured to said support member for rotating about a second axis which extends transverse to said first axis, wherein said rigid mounting member defines a sight line for said precision tactical mount;

a slide mechanism extending between said rigid mounting member and said support member for selectively determining an angle at which said rigid mounting member is disposed relative to said support member, said slide mechanism having a first slide member including a threaded rod having one end pivotally secured to said support member at a first pivot axis which is distally disposed from said second axis, a second slide member pivotally connected to said rigid mounting member at a second pivot axis which is distally disposed from said first pivot axis, and a third slide member which slidably connects between said first slide member and said second slide member;

a screw adjustment comprises a threaded collar which is pivotally mounted to said third slide member for threadingly receiving said threaded rod and rotating to determine lineal extension of said threaded rod relative to said third slide member;

a friction lock extending between said third slide member and said second slide member, said friction lock having a friction block which moveably secured to said second slide member for selectively moving to press against said third slide member with different levels of a friction force there-between, which determines a level of a second force required to pivot said rigid mounting member relative to said support member about said second axis independent of said screw adjustment; and wherein azimuth and elevation for said sight line are selectively determined by moving said rigid mounting member relative to said spindle and said support member by selective application of said first force and said second force, and by operation of said screw adjustment.

14. The precision tactical mount according to claim 13, wherein a thread axis of said screw adjustment is disposed at an acute angle to said sight line defined by said rigid mounting member for obtaining a fine thread control adjustment with course screw threads.

15. The precision tactical mount according to claim 14, wherein said angle between said thread axis of said screw adjustment and said sight line is approximately ten degrees.

16. The precision tactical mount according to claim 14, wherein said angle between said thread axis of said screw adjustment and said sight line is approximately ten degrees.

17. The precision tactical mount according to claim 13, wherein said selective friction actuator comprises a threaded pin and a grip handle mounted to a first end of said threaded pin, said grip block has a threaded hole for threadingly securing to a second end of said threaded pin, and a first through hole extends from an exterior of said support member into said first aperture for passing said threaded pin for securing within said threaded hole of said grip block and lineally moving said grip block with respect to said spindle.

18. The precision tactical mount according to claim 13, wherein said third slide member comprises a sleeve having a having a longitudinally extending bore and a longitudinally extending slot, and said friction lock comprises:

said friction lock is provided by an inner friction block secured to a first end of said second slide member, said inner friction block having an annular-shaped surface for slidably moving within said longitudinally extending bore of said sleeve, and a lateral hole disposed to extend from one side of said annular-shaped surface;

an outer friction block having an inwardly facing surface for slidably engaging said sleeve, and a second through hole extending transverse to said inwardly facing surface;

a friction adjustment handle having a fastener pin hole; and a fastener pin extending from said lateral hole in said inner friction block, through said longitudinally extending slot in said sleeve, through said second through hole in said outer friction block and into said fastener pin hole in said friction adjustment handle, wherein one of said fastener pin hole and said lateral hole is threaded for engaging a threaded end of said fastener pin to press said outer friction block and said inner friction block together with said sleeve disposed there-between to selectively determine said level of said second force required to pivot said rigid mounting member relative to said support member about said second axis independent of said screw adjustment.

19. A precision tactical mount comprising:

a spindle secured to a mounting plate, said spindle having a spindle surface which circumferentially extends to define a spindle axis;

a support member having a central bore for receiving said spindle, with said central bore disposed for rotating about said spindle axis, and said support member having a first aperture which extends transverse to said central bore, and a first through hole which extends from an exterior of said support member into said first aperture;

a grip block having a second aperture for rotatably receiving said spindle, said second aperture defining a grip block surface for pressing against said spindle surface, said grip block having an exterior periphery which is slidably received within said first aperture in said support member for moving relative to said spindle and pressing said grip block surface against said spindle to define an engagement region between said grip block and said spindle, and said grip block having a threaded hole extending transverse to said first axis;

a threaded pin and a grip handle, said grip handle mounted to first end of said threaded pin and said second end of said threaded pin extending through said first through hole in said support member and threadingly secured within said threaded hole formed into said grip block, wherein said grip handle is selectively moved to rotate said threaded pin and move said grip block within said first aperture transverse to said first axis, providing selected friction forces for determining a level of a first force required for rotating said support member about said spindle;

a rigid mounting member pivotally secured to said support member for rotating about a second axis which extends transverse to said first axis, wherein said rigid mounting member defines a sight line for said precision tactical mount;

a slide mechanism extending between said rigid mounting member and said support member for selectively determining an angle at which said rigid mounting member is disposed relative to said support member, said slide mechanism having first slide member which includes a threaded rod having one end pivotally secured to said support member at a first pivot axis which is distally disposed from said second axis, a second slide member pivotally connected to said rigid mounting member at a second pivot axis which is distally disposed from said first pivot axis, and a sleeve which slidably connects between said threaded rod and said second slide member;

a screw adjustment having a threaded collar which is pivotally mounted to said sleeve for threadingly receiving said threaded rod and rotating to determine lineal extension of said threaded rod relative to said third slide member;

a friction lock extending between said sleeve and said second slide member, said friction lock having an inner friction block secured to a first end of said second slide member, said inner friction block having an annular-shaped surface for slidably moving within said longitudinally extending bore of said sleeve, and a lateral hole disposed to extend from one aide of said annular-shaped surface;

an outer friction block having an inwardly facing surface for slidably engaging said sleeve, and a second through hole extending transverse to said inwardly facing surface;

a friction adjustment handle having a fastener pin hole;

a fastener pin extending from said lateral hole in said inner friction block, through said longitudinally extending slot in said sleeve, through said second through hole in said outer friction block and into said fastener pin hole in said friction adjustment handle, wherein one of said fastener pin hole and said lateral hole is threaded for engaging a threaded end of said fastener pin to press said outer friction block and said inner friction block together with said sleeve disposed there-between to selectively determine a level of a second force required to pivot said rigid mounting member relative to said support member about said second axis independent of said screw adjustment; and wherein azimuth and elevation for said sight line are selectively determined by moving said rigid mounting member relative to said spindle and aid support member by selective application of said first force and said second force, and by operation of said screw adjustment.

20. The precision tactical mount according to claim 13, wherein a thread axis of said screw adjustment is disposed at an acute angle to said sight line defined by said rigid mounting member for obtaining a fine thread control adjustment with course screw threads.

* * * * *